United States Patent [19]

Gorelik

[11] 4,266,343

[45] May 12, 1981

[54] SPRING LOADED CLAMPING DEVICE FOR DRAFTING PARALLEL LINES

[76] Inventor: Roman Gorelik, 1150 S. Glencoe St., Denver, Colo. 80222

[21] Appl. No.: 75,497

[22] Filed: Sep. 13, 1979

[51] Int. Cl.[3] ..... B43L 13/00

[52] U.S. Cl. ..... 33/41 D

[58] Field of Search ..... 33/41 R, 41 D, 44; 401/35, 52, 131, 193, 195, 233, 256, 257

[56] References Cited

U.S. PATENT DOCUMENTS 3,245,146 4/1966 Rogers ..... 401/193 X

FOREIGN PATENT DOCUMENTS 171388 11/1951 Austria ..... 33/41 D 233714 5/1925 United Kingdom ..... 33/41 D

*Primary Examiner*—Charles E. Phillips

*Attorney, Agent, or Firm*—Gary M. Polumbus

[57] ABSTRACT

A device for drafting parallel lines by positioning a pair of pencils or pens between clamping portions of spring biased arms. The arms are joined at one end, the other ends snapping together to retain the pencils in the device.

2 Claims, 3 Drawing Figures

SPRING LOADED CLAMPING DEVICE FOR DRAFTING PARALLEL LINES

BACKGROUND OF THE INVENTION

1. Field of the Invention

This invention relates to drafting instruments, and more particularly to drafting instruments of the type used in making parallel lines.

2. Description of the Prior Art

Draftsmen and artists frequently draw parallel lines in bracketing titles and separating notes from drawings. The normal method for drawing parallel lines utilizes a template having spaced perforations adapted to receive the point of a pencil or pen. A draftsman inserts a pencil into one of the perforations of the template and slides the pencil along a 'T' square or other straight edge for the required distance. The process is then repeated by inserting the pencil into an adjacent perforation and moving the template the same distance. It is readily seen that this procedure requires two separate steps in order to draw a pair of parallel lines.

There are instruments that utilize a pair of leads or inking devices within a single drawing instrument. This type of instrument is often derived from a compass, utilizing a second lead in place of the pivot point portion of a conventional compass. Apparatus of this type are therefore relatively expensive.

OBJECTS AND SUMMARY OF THE INVENTION

The principle object of the present invention is to provide an inexpensive, simple, easily used drafting instrument for making parallel lines.

Another object of the present invention is to provide a drafting instrument that can make parallel lines by use of conventional pencils or pens.

Still a further object of the present invention is to provide a drafting device for making parallel lines wherein the distance between parallel lines can be adjusted to suit the user.

The present invention therefore includes a pair of opposed arms each having a clamping portion extending away therefrom toward the opposite arm. The arms are joined at one end so as to enable movement of the other end and thereby opening and closing of the device.

The clamping portion of each arm is adapted to clamp to the body of the pencil by the use of teeth of the proper dimension. The point of a pencil is positioned by an inclined leaf spring having a hemispherical opening adapted to receive each of the pencils near the point and hold the pencils adjacent to each other near their points.

The entire clamping device is closed and locked by closure of a clasp defined by a cupped portion on one arm which receives and engages a rib portion on the other arm.

DESCRIPTION OF THE PREFERRED EMBODIMENT

Figure 1:
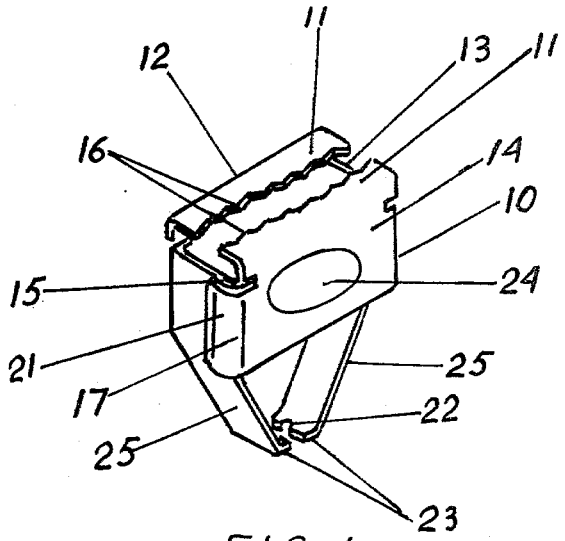
FIG. 1 is a perspective view of the present invention without the pencils.
Figure 3:
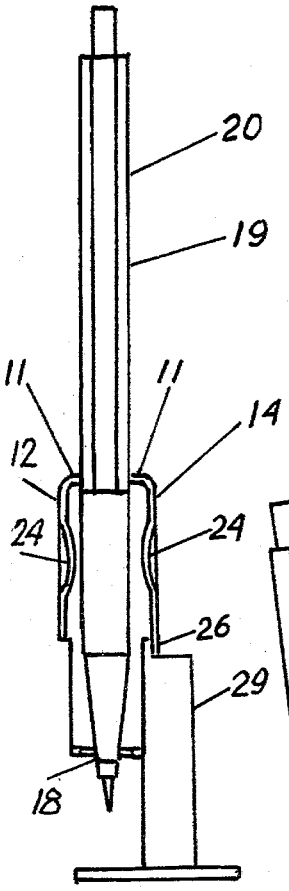
FIG. 3 is a side section of the present invention containing a pair of pencils and mounted to a pedestal.

As best seen in FIG. 1, a clamping device 10 having a pair of generally symmetric arms 12 and 14 is shown. Each of the arms 12 and 14 is of generally planar configuration each plane being in a parallel relationship to the other when the clamping device 10 is closed.

The arms 12 and 14 are permitted to rotate away from each other through an integral connecting member 13 located at one side of the clamping device 10 intermediate the arms. The member 13 is of leaf spring construction so that in its unbiased position the arms 12 and 14 are open in alligator fashion. The member 13 holds the arms in a spaced relationship when the arms are closed in a manner to be described more fully hereinafter.

The clamping device 10 is adapted to hold and retain a pair of pencils or pens 20 (see FIG. 2), each having a generally hexagonal or cylindrical body 19 and a point 18, in such a manner that the point 18 of each pencil 20 is held in close proximity to the other. Use of the invention with a straight edge (not shown) therefore results in a pair of parallel lines being drawn by the points 18 of the adjacent pencils. One pencil point 18 is guided by the straight edge and the other pencil is maintained by an angle (not shown) or the like, so that a line connecting the points 18 of the pencils 20 is perpendicular to the straight edge. Parallel lines are thus drawn by moving the clamping device 10 along the straight edge while holding the points against an angle.

Opposite the member 13 an integral extension 17 extends outwardly away from arm 14. The extension 17 is of longitudinal dimensions corresponding to the member 13. This dimension is predetermined so that the body 19 of the pencils 20 is frictionally retained by the clamping device 10 when it is closed.

The body 19 of each pencil is held between clamping portions 11 extending inwardly away from each arm 12 and 14, and along the length thereof toward the opposite arm. The clamping portions 11 are adapted to frictionally hold the body 19 of a pair of pencils 20 in a space therebetween when the arms are closed, the clamping portions being parallel to each other on closure. Serrated teeth 16 along the edge of both clamping portions are included to assist in gripping the body 19 of the pencils 20 and thereby hold the body in a predetermined place which assists in determining the width between parallel lines to be drawn by the device. Depending on which tooth is selected for placement of the body 19, an angle 27 between the pencils 20 is defined to thereby change the distance between the points 18 of the pencils 20 and therefore the width between any parallel lines drawn.

A hemispherical raised rib 21 is disposed vertically along the end of the extension 17 parallel to the planes defined by each of the arms 12 and 14 and in vertical alignment with them. The rib 21 is matingly received by a cupped or raised portion 15 integrally connected to the arm 12 and extending inwardly toward the arm 14. The raised portion extends along the entire height of arm 12.

Therefore the clamping portions 11 can be closed onto the body 19 of a pencil 20 by biasing the spring member 13 and closing the arms 12 and 14. As the arms are closed toward each other the rib 21 engages cupped portion 15 which forces the extension 17 inwardly. Upon complete closure, the rib matingly fits within the cupped portion until such time as the extension is biased inwardly away from the cupped portion and the two arms are permitted to rotate relative to each other about the member 13. In the closed position the clamping portions are spaced apart just enough to frictionally grip the pencil body 19 therebetween.

Figure 2:
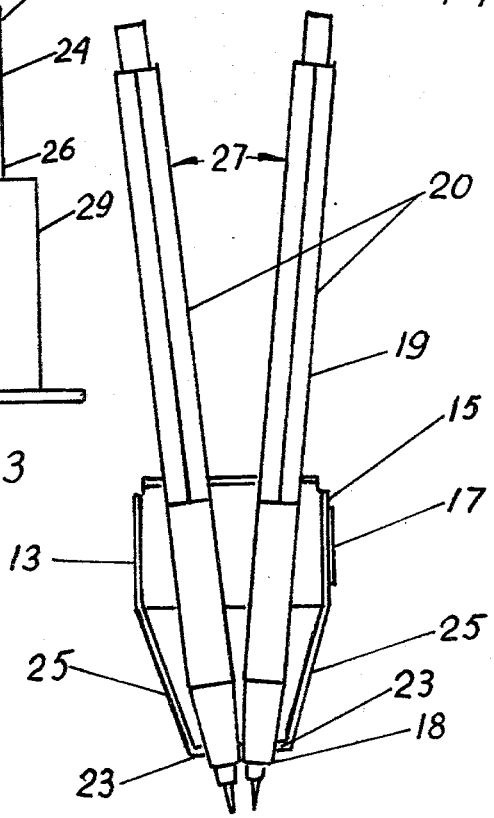
FIG. 2 is a front section of the invention with a pair of pencils positioned in it.

A pair of symmetric inclined leaf springs 25 extend downwardly from the extension 17 and the member 13 respectively in such a manner as to converge inwardly in a shoulder 23 at a point below where the body 19 of the pencils 20 is grasped by the clamping portions 11. Semicircular openings 22 in each shoulder 23 are adapted to receive the pencils 20 at or near the points 18 (FIG. 2). Each of the leaf springs 25 thus exerts a force against the pencil near the point 18 so that the pair of pencils 20 are positioned frictionally each to the other near their respective points 18. The distance between the openings 22 of the leaf springs 25 is therefore best kept slightly less than the space required to fit both pencils 20 therebetween. In this manner the leaf springs are slightly bent and the tension in the springs maintains the points 18 fixed in near proximity each to the other.

A mounting pedestal 29 is provided to support the entire combination for easy storage and access. It can be joined to the invention through a prong 26 located on the invention and received by the pedestal. For convenience of the user, each of the arms 12 and 14 has a concave indentation 24 to facilitate handling of the device 10 and closing the arms 12 and 14.

In assemblying the invention, a pair of pencils are placed so that their bodies 19 are received by any one of the plurality of serrated teeth 16 along the clamping portion 11 of the arm 14. The points 18 of the pencils are placed through the semicircular openings 22 of the leaf springs 25. The bodies 19 can be placed in any one of the serrated teeth 16 to vary the angle 27 between the pencils 20. In this manner the distance between the points 18 can be varied to change the distance between parallel lines to be drawn. Once the pencils are properly placed in the device, the second arm 12 is rotated against the bias of the member 13 and clamped shut by engagement of the rib 21 with the cupped portion 15. Once closed, the clamping device 10 clamps the body 19 of the pencils between the clamping portions 11 and retains the points between the inclined leaf springs 25. The device can then be used in conjunction with a 'T' square or other straight edge to draw parallel lines as desired by the user. The pencils 20 may be left in the device 10 or removed for use independent of the invention.

Although the present invention has been described with a certain degree of particularity, it is understood that the present disclosure has been made by way of example and changes in detail or structure may be made without departing from the spirit of the invention, especially as defined in the appended claims.

What I claim is:

1. An apparatus for drawing parallel lines, comprising in combination:

two line making means, each including a body of generally elongated cylindrical shape ending in a marking point;

a pair of generally flat planar arms disposed in opposed facing relationship and adapted to be operatively connected together to clamp said line making means therebetween, each arm including a clamping portion facing the opposite arm, said clamping portions adapted to grasp the body of the said two line making means therebetween; and a leaf spring connected to and extending from each of said arms, each of said leaf springs having an opening at the termination thereof adapted to receive and hold said line making means, each of said leaf springs exerting a force against one of said line making means to thereby position said one line making means against the other line making means.

2. An apparatus for drawing parallel lines, comprising in combination:

two line making means, each including a body of generally elongated cylindrical shape ending in a marking point;

a pair of generally flat planar arms disposed in opposed facing relationship and adapted to be operatively connected to each other at one end thereof by an integral connecting member;

an integral extension on one of said arms extending toward the opposite arm, said integral extension further having a rib at its furthest projection away from said arm;

a pair of inclined leaf springs, said leaf springs extending downwardly and inwardly from said integral extension and said integral connecting member respectively, each leaf spring terminating in an opening adapted to receive and hold said line making means, each of said leaf springs exerting a force against one of said line making means to thereby position said one line making means against the other line making means; and a raised portion extending a relatively short distance away from the other arm adapted to matingly receive the rib of said integral extension and grasp the cylindrical shape of said line making means between said arms in a fixed relationship to each other.

* * * * *